United States Patent [19]

Segawa

[11] 4,406,414

[45] Sep. 27, 1983

[54] LINERS FOR USE IN A ROD MILL

[76] Inventor: Hiyotaro Segawa, 6-23,, Otemachi, Noshiro, Akita-ken, Japan

[21] Appl. No.: 194,867

[22] Filed: Oct. 7, 1980

[30] Foreign Application Priority Data

Oct. 9, 1979 [JP] Japan ..... 54-131084

[51] Int. Cl.³ ..... B02C 11/22

[52] U.S. Cl. ..... 241/183

[58] Field of Search ..... 241/183, 182

[56] References Cited

U.S. PATENT DOCUMENTS 2,362,811 11/1944 Fitzgerald ..... 241/183

2,949,247 8/1960 Rosenqvist et al. ..... 241/183

4,243,182 1/1981 Dugger, Jr. ..... 241/183

FOREIGN PATENT DOCUMENTS 810438 3/1959 United Kingdom ..... 241/183

*Primary Examiner*—Willie G. Abercrombie

*Attorney, Agent, or Firm*—McGlew and Tuttle

[57] ABSTRACT

Among a plurality of liners installed in the inner circumference of a rod mill, lifters are partially removed from liners which contact portions of rods to be bent by the rolling of rods during the operation of a rod mill, thus alleviating the bending of rods and equalizing the amount of wear on all liners.

8 Claims, 9 Drawing Figures

LINERS FOR USE IN A ROD MILL

FIELD AND BACKGROUND OF THE INVENTION

The present invention provides a structure in which rods which are used in a rod mill, are allowed to rotate in parallel with the axis of rotation of an ore grinding machine (hereinafter referred to as a rod mill), without being bent.

A rod mill has its internal circumference lined with liners, and rotates after ore and rods are put in, and crushers and grinds ore (hereinafter simply referred to as grinds), with the rods rolling on the liners. Among various types of rod mills, there is a mill of the central circumference discharge type in which ore is fed from two end ports of its main body and crushed ore is discharged from the central circumference. FIG. 1 shows the liner assembly of a main body of such a mill of the central circumference discharge type, with the cylindrical main body cut along the line A—A′ or B—B′ and stretched over a flat surface, where the side edges A—A′ and B—B′ are seemlessly butted to form a cylinder with its ends respectively formed into a circle by the edges A—B and A′—B′. As seen in the developed view of the main body liner assembly in FIG. 1, the liners or first liner members 1 are arranged in a plurality and in parallel throughout the inner circumference of the main body, and the liners or second liner members 3 which have discharge ports 2 are arranged along the circumference of a center portion of the main body. The liners 3 having the discharge ports may be arranged either side by side as shown in FIG. 1 or with several liners 1 interposed therebetween along the circumference. The liners 1 arranged throughout the main body are integrally formed at their liner bases 4 with lifters 5 which push ore and rods (both not shown in the drawings) up. This applicant has worked out several patented inventions of liners 1 with lifters 5 which are based on the rod mill liners disposed in Japanese Pat. No. 574,843 and the rod mill liners of the aforementioned invention are also utilized in the present invention. The present invention will be explained hereunder with reference to FIG. 6. In the present invention, the shape and the location of lifter 5 relative to a liner base 4 are so selected that the top of the lifter is shifted adjacent the attaching hole 6 of the liner when the lifter 5 reaches its wear limit, by positioning the lifter forward, with respect to the attaching hole 6 of an attaching bolt (not shown) in the direction of rotation of the rod mill by a distance which is determined by using a certain ratio of the rod diameter as a measure, with the aim to prolong the life of the liners and maintain ore grinding efficiency of the rod mill.

There are peculiar phenomena in the progress of wear of liners by grinding ore in a rod mill of the central circumference discharge type, regardless of the use of liners with either the lifters 5 of said invention or different lifters which are not relating to said invention. The phenomena are illustrated in FIG. 2 which is an enlarged end view of the B—B′ edge in FIG. 1. In the liner 3 with central discharge port and in the liners 1 which are arranged on both sides of the liner 3 towards the ends of the mill main body, the wear of the liner bases 4 is shown by the chain line a and that of the lifters 5 is shown by the chain line b. The chain lines a and b show the conditions of wear when the liners 1 at the extreme ends of the mill reached their wear limit. Those conditions indicate that the liners positioned closer to the ends show more wear than the liners positioned closer to the center of the mill, the wear being caused by rods having a length which is almost the same as the lateral length or width B—B′ in FIG. 2. FIG. 3 shows the wear conditions of liners, when central liners 3 with discharge ports 2 are not provided with lifters 5. Contrary to the conditions in FIG. 2, the liners closer to the center show more wear than those closer to the ends. Those wear conditions are the phenomena to be effected by various factors such as the movement of rods which are pushed up together with ore, rolled around or dropped onto the liners while the mill body is rotating, the amount of ore to be ground, the flowing condition of ore in the mill, the rotational speed of the mill, or the like.

In order to understand the cause for those phenomena, the conception of the applicant, who has studying many years in working sites in Japan and abroad, is described hereunder. Considering the grinding and rod motion, rods loaded in a mill are pushed up by lifters in the direction of rotation, flow and fall down in repetitive manner during the rotation of the mill, and the loaded ore is gradually ground down, with the rod motion being effected mostly by the lifters on the liners. A rod in motion is not kept in parallel with the rotational axis of the mill while it is being pushed up, flows and falls down, but has its ends twisted, or its whole length bent, taking various shapes in motion. Considering the wear of liners and rods, the liners positioned in the ore feeding side wear more than other liners in almost every case, though little difference is observed depending on the type and construction of the rods and the kind and content of ore to be ground. Further, a rod shows such irregular wear that the center portion of 90 mm in original diameter wears to about 40 mm in diameter while the end portions wear to such an extreme condition that they look like spearheads. Considering the wear of liners and rods and the grinding effect of rods, the grinding of raw materials are accomplished by impact taking place between two rods or between a rod and liners, therefore, the grinding action would progress smoothly and the amount and quality of the ground ore would be kept steady, if the liners and the rods could wear while keeping their original profiles. However, due to the irregular motion of rods in a mill, parts of the rods and liners (including lifters if applicable) wear to the extreme, rendering a decrease in quantity and a deterioration in quality of grinding usually being inevitable. Thus, it is conventional in this industry that the operation of a mill must be stopped for certain days to replace worn liners with new ones by letting workers in the mill to perform replacement operations manually, whenever part of the liners have worn to the limit. This means waste of time in service in that all of the liners must be replaced even though most of them are in a serviceable condition.

SUMMARY OF THE INVENTION

It is the primary object of the present invention to provide practical liners of adequate configurations for use in a grinding machine, particularly for a rod mill.

According to the present invention liners are characterized in that lifters are partially removed from liners located where strong external force would be applied by lifters if not removed, to tend to bend rods when they are pushed up together with ore to be ground in a rod mill, so that the bending of the rods are alleviated and dampened, thus the service lives of liners and rods are prolonged and the grinding efficiency is improved.

Figure 1:
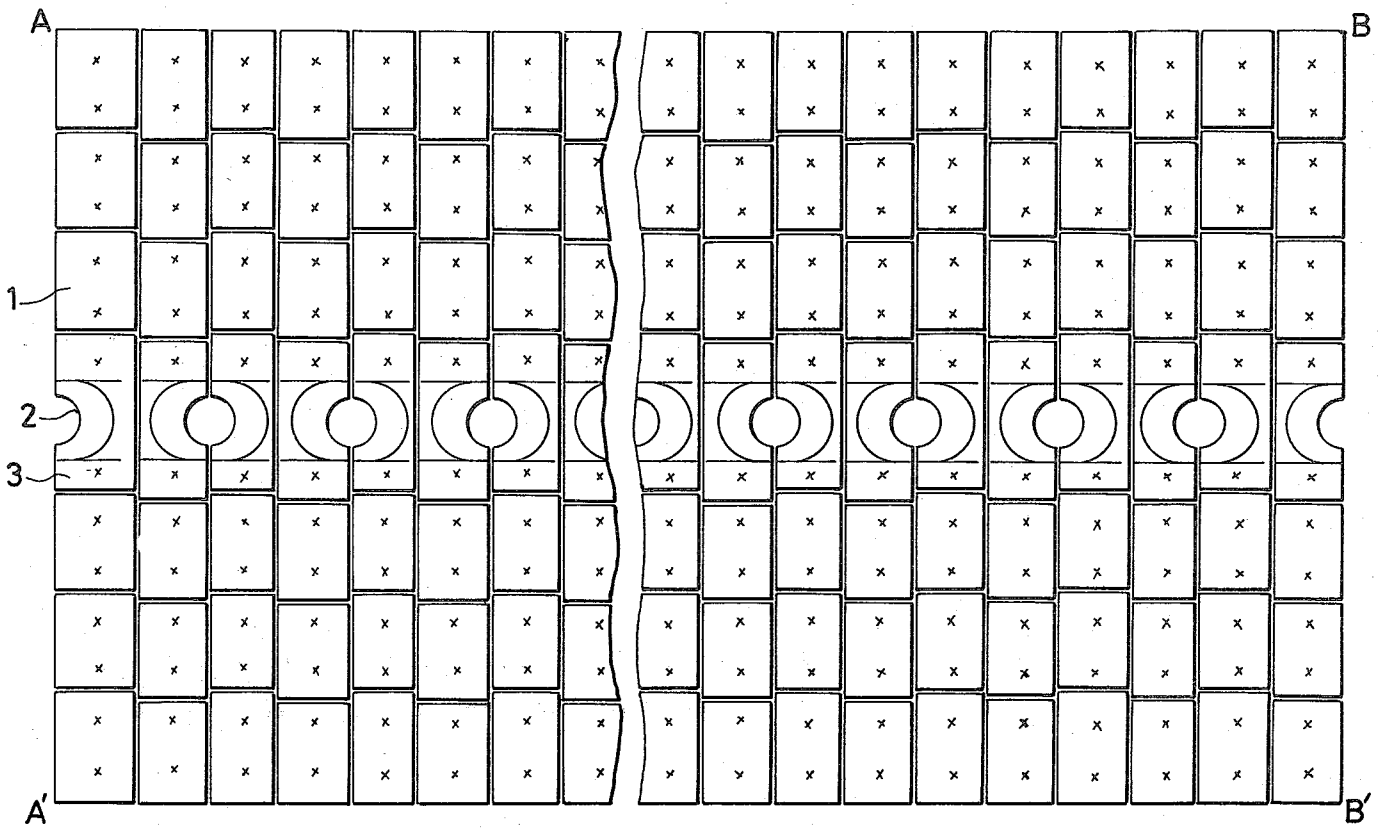
FIG. 1 is a developed view of a rod mill liner assembly according to the present invention.
Figure 2:
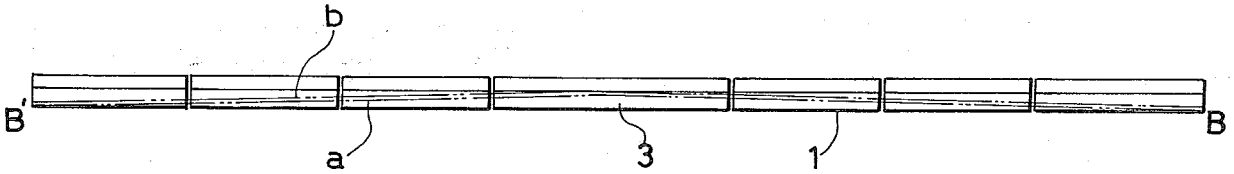
FIGS. 2 and 3 show the wearing conditions of known liners in rod mills of the prior art for comparison with the condition of an embodiment of the present invention.
Figure 3:
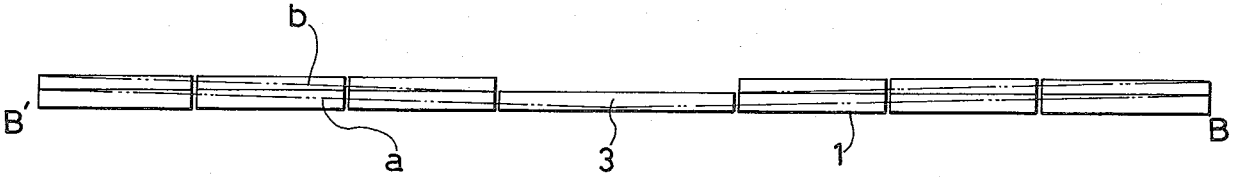
Figure 4:
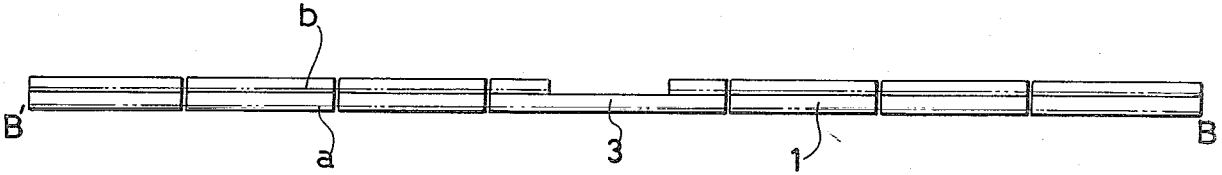
FIG. 4 shows the wearing condition of rod mill liners according to the present invention.
Figure 5:
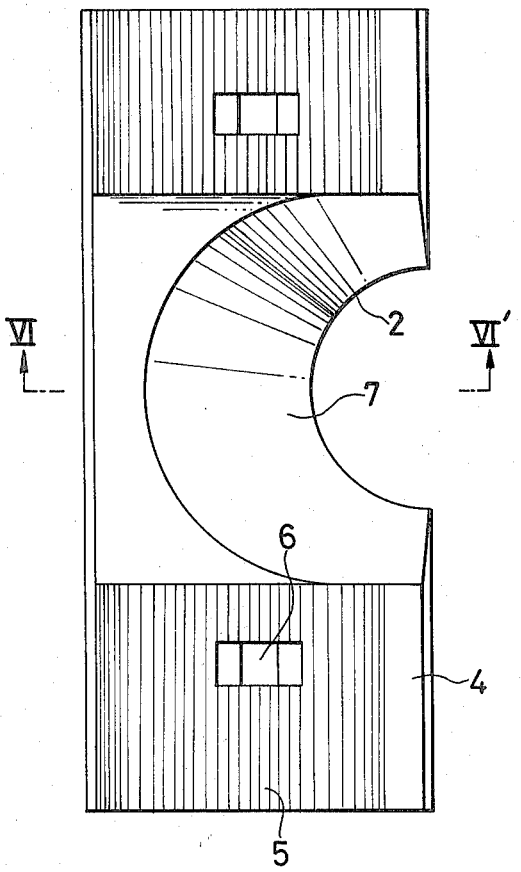
FIG. 5 is a plan view of the left half of a rod mill liner according to the present invention.
Figure 6:
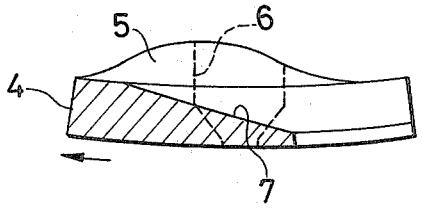
FIG. 6 is a sectional view, taken along the line VI—VI' in FIG. 5.
Figure 7:
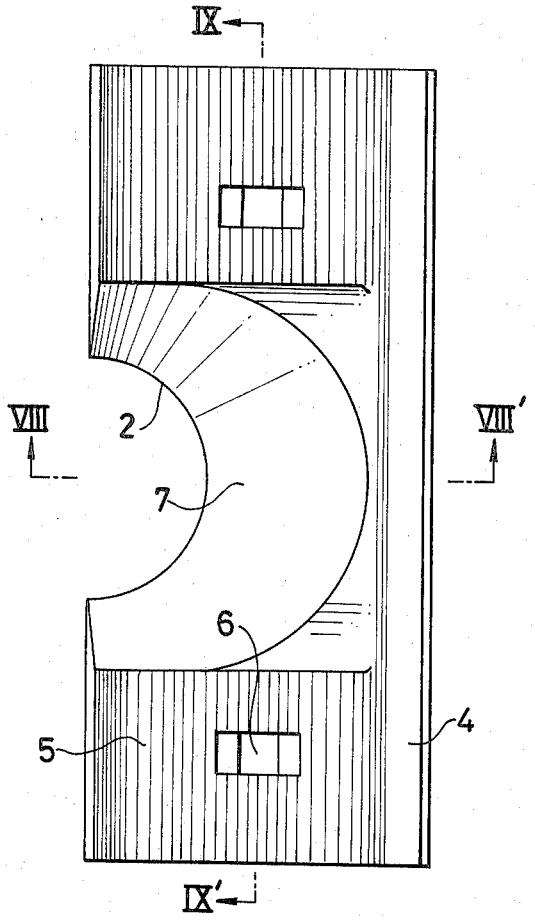
FIG. 7 is a plan view of the right half of a rod mill liner according to the present invention.
Figure 9:
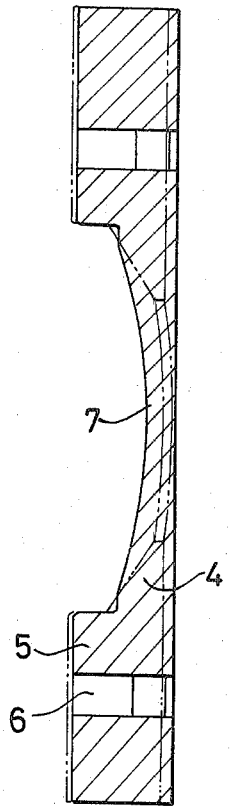
FIG. 9 is a sectional view, taken along the line IX—IX' in FIG. 7.
Figure 8:
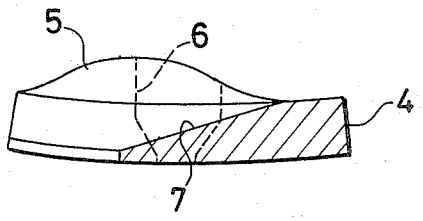
FIG. 8 is a plan view, taken along the line VIII—VIII' in FIG. 7.

DETAILED DESCRIPTION OF THE INVENTION:

The applicant, based on the aforementioned study, considered that the wear of a lifter and liner on liners with lifters, is closely related to the motion of the rods, the aforementioned peculiar phenomena taking place due to the twisting of the ends of the rods and a bending through the full length of the rods, therefore it is most important for the suppression of those phenomena to alleviate and dampen the external force being applied to the center portion of a rod, and thus an empty space should be provided in the lifter portion of liner 3 with discharge port 2. Accordingly the applicant conducted experiments using the liner 3 with lifter 5 as shown in FIG. 4, the liner 3 being featured to be between liners in FIGS. 2 and 3. The feature to be between the two, that is, the width of lifter 5 to be left on both sides of the discharge port 2 of liner 3 in the direction parallel to the rotational axis of a rod mill (line B—B' in FIG. 4), was experimented with as follows. Two liners 3 with discharge ports 2 shown in FIGS. 5 and 7 were arranged in contact with each other along the edges parallel to edges A—A' and B—B' and defined a circular discharge port 2. In order for the liners 3 to be installed in a rod mill together with liners 1 without discharge ports 2 as shown in FIG. 1, the liners 3 had to have the same width in the direction parallel to the end edge A—B as that of liners 1, with lifters 5 provided on respective liners 3 similarly to liners 1. The liners 3, a pair of which are combined to define a circular discharge port 2, being provided with lifters 5 in two ridges on either side of the port 2, have such large weight as to render the installation into a rod mill rather difficult, therefore they are fabricated as shown in FIGS. 5 and 7. They are installed in a mill body through the use of bolt holes 6 provided in the lifters as shown in the center array of liners in FIG. 1. The length in the direction parallel to edge A—A' (also parallel to the rotational axis of the rod mill) of each liner 3 defining a circular discharge port 2 when used in pairs, is made to be 790 mm, the diameter of the discharge port is 240 mm, and the lifter 5 having a width of 175 mm each in the direction parallel to edge A—A' is integrally formed on the liner base 4 from either end of the liner base 4, with the liner base 4 interposed between the two lifters, forming countersunk slanting surface 7 between the circumference of discharge port 2 and the lifter 5 and the surface of the liner base 4. Thereby the liner bases 4 formed between the lifters 5 comprise a circumferential gap or strip in the center portion of the mill. This rod mill, after being used, showed the wear line a of the liner bases and the wear line b of the lifters as illustrated in FIG. 4. The rods also showed wear of their diameters which was uniform throughout the full length thereof in cooperation with those wear lines a and b. The result was a production gain of ground ore by about 38% compared to the production with conventional liners.

The study on the results of various experiments has shown that the best performance has been obtained when a little more than 10% of the length of lifter 5 in the direction parallel to the rotational axis of a rod mill has been removed from the lifter 5 on the liner 3 with discharge port in the center. That is 10% of the total length of lifter 5 across the entire mill. Since the length of the liner 3 along the edge B—B' is generally more than that of the liner 1 as shown in FIG. 4, the length of the liner where the part of the lifter is removed can be defined by a certain percentage of the full length of the liner 3, or by a certain percentage of the length of a rod mill or of the diameter of a new rod. In this example the length of the rod mill was 3900 mm and the diameter of the rod was 75 mm, however a good result is possibly expected by the length of a portion without lifter 5 which is even more than 20% of the length of a rod mill with the rod having the diameter of 90–120 mm. Further, when the length of a rod mill is increased, a rod to be used is also made longer, thereby the bend, if formed from the center of the length of the rod, will progress toward the ends from the center portion of the rod, making less sharp curvature compared with a shorter rod. So it may be possible to alleviate and dampen the bending of a rod by providing liner 1 (without the discharge port 2), on which portion a of lifter 5 is removed, in the circumferences located closer to the ends than to the center of the rod mill. Furthermore, the materials for liners can now be rubber or stone and other than metals, depending on the ore to be ground. In this example, a rod mill of center circumference discharge type is shown, but the invention can be applied for alleviating the bending of rods to rod mills of the types, wherein ore is fed from one end and discharged from other end, or ore is fed from one end and discharged from discharge ports on the circumference adjacent the other end.

The invention thus resides in a liner for a rod mill which comprises a plurality of liners or liner members 1, 3 which have bases 4 that form a cylindrical base with a plurality of lifters 5 which extend across the cylindrical base and which are interrupted at the axial center of the cyclindrical base by about 10% of the base axial length or even about 20% of that length.

What is claimed is:

1. A liner assembly for a rod mill comprising, a cylindrical base having an axial length and an inner circumferential surface, and a plurality of lifters circumferentially spaced and projecting radially inwardly of said circumferential surface, each of said lifters being interrupted adjacent an axial center of said axial length to form a gap of a selected length substantially less than said axial length, whereby rods rolling in said liner assembly tend to wear uniformly and tend to cause uniform wearing of said liner assembly along said axial length, said liner assembly comprising a plurality of first liner members each carrying a segment of at least one lifter and a plurality of second liner members in the central vicinity of said cylindrical base along said axial length with pairs of said second liner members defining openings through said cylindrical base, each of said second liner members carrying a spaced pair of lifter segments positioned on opposite sides of respective openings through said cylindrical base.

2. A liner assembly according to claim 1, wherein said selected length is approximately 10% of said axial length.

3. A liner assembly according to claim 1, wherein said selected length is approximately 20% of said axial length.

4. A liner assembly according to claim 1, wherein said selected length is greater than 10% of said axial length and said selected length is entirely on said second liner members.

5. A liner assembly according to claim 4, wherein said selected length is about 20% of said axial length.

6. A liner assembly according to claim 1, wherein each second liner member has a countersunk slanting surface extending toward a respective opening through said cylindrical space and positioned entirely within said gap of said lifters.

7. A liner assembly according to claim 2, wherein for an axial length of about 3,900 mm a rod diameter for use with the liner is selected to be 75 mm.

8. A liner assembly according to claim 3, wherein for an axial length of about 3,900 a diameter of rods to be used with the liner assembly is from 90 to 120 mm.

* * * * *